United States Patent [19]

Stoeberl

[11] Patent Number: 4,549,826

[45] Date of Patent: Oct. 29, 1985

[54] PAPER FEED APPARATUS FOR TYPEWRITERS OR BUSINESS MACHINES HAVING A PAPER LEVELLING GAP DISPOSED IN THE PAPER GUIDANCE CHANNEL

[75] Inventor: Walter Stoeberl, Holzkirchen, Fed. Rep. of Germany

[73] Assignee: Siemens Aktiengesellschaft, Berlin & Munich, Fed. Rep. of Germany

[21] Appl. No.: 610,866

[22] Filed: May 16, 1984

[30] Foreign Application Priority Data

Jun. 1, 1983 [DE] Fed. Rep. of Germany ..... 3319961

[51] Int. Cl.[4] ..... B41J 11/64

[52] U.S. Cl. ..... 400/708; 400/54; 400/622; 101/233; 226/45; 226/100; 271/263

[58] Field of Search ..... 271/262, 263; 400/54, 400/366, 708, 622, 624; 101/232, 233; 226/45, 100

[56] References Cited

U.S. PATENT DOCUMENTS

| | | | |
|---|---|---|---|
| 3,722,773 | 3/1973 | Plate et al. | 271/263 |
| 3,860,234 | 1/1975 | Parenti et al. | 271/263 |
| 3,875,860 | 4/1975 | Barber | 101/233 |
| 4,111,565 | 9/1978 | Jagger | 400/708 |
| 4,141,660 | 2/1979 | Bommershein et al. | 400/708 |
| 4,154,437 | 5/1979 | Butcheck et al. | 271/263 |
| 4,420,151 | 12/1983 | Kobayashi | 271/263 |
| 4,449,399 | 5/1984 | Hain | 271/263 |
| 4,461,212 | 7/1984 | Geney | 400/56 |
| 4,469,454 | 9/1984 | Crean | 400/708 |
| 4,491,929 | 1/1985 | Ikoma et al. | 271/263 |

FOREIGN PATENT DOCUMENTS

| | | | |
|---|---|---|---|
| 1176156 | 8/1964 | Fed. Rep. of Germany | 400/622 |
| 2505642 | 8/1976 | Fed. Rep. of Germany . | |
| 2370596 | 7/1978 | France | 400/622 |
| 224938 | 12/1983 | Japan | 271/263 |

*Primary Examiner*—William Pieprz

*Attorney, Agent, or Firm*—Hill, Van Santen, Steadman & Simpson

[57] ABSTRACT

A paper feed apparatus for line printer means for the transport of single-ply and multi-ply paper contains a paper levelling gap in the ingress region of the paper guidance channel. The paper levelling gap consists of a stationary part and of a slide capable of excursion relative to said stationary part, with said slide communicating with a sensing means. Given transgression of a prescribed slot width due to buckling of the multi-ply paper, the paper feed is interrupted via the sensing means and a warning light is actuated.

9 Claims, 3 Drawing Figures

PAPER FEED APPARATUS FOR TYPEWRITERS OR BUSINESS MACHINES HAVING A PAPER LEVELLING GAP DISPOSED IN THE PAPER GUIDANCE CHANNEL

BACKGROUND OF THE INVENTION

1. Field of the Invention

The invention relates to a paper feed apparatus for printer means and more particularly to a paper feed apparatus with sensing means for detecting curled paper ends.

2. Description of the Prior Art

Typewriters or business machines such as, for example, teleprinters employ a single-ply or multi-ply continuous rollpaper as the recording medium. The end of the roll of this continuous rollpaper differs depending on the paper manufacturer. Some multi-ply paper presents a large curvature at the end of the roll, thus requiring a powerful line feed motor in order to pull the curved ends through the paper guidance channel in the paper feed apparatus. Pronounced folds at the end of the roll can thereby lead to the blockage of the line feed drive. Folds occuring at the end of the roll lead to information losses due to blockages of the line feed drive.

In order to smooth out large curvatures of the end of the roll, it would therefore be necessary to have very strong line feed motors that are unwieldly in terms of their dimensions or, very expensive.

When the paper supply is monitored in a known manner according to presently available sensors, the paper feed must be interrupted when the end of the paper to be imprinted is still situated at a great distance from the entrance of the paper guidance channel in order to avoid malfunctions. This results in a high paper consumption.

SUMMARY OF THE INVENTION

An object of the invention is to provide a paper feed apparatus which can process single-ply or multi-ply continuous rollpaper as loss-free as possible.

The continous roll paper can be completely imprinted in that a paper levelling gap which smooths out curvatures in the end of the roll of the continuous rollpaper is disposed in the ingress of the paper guidance channel. Folds at the end of the roll that are too pronounced and that could potentially lead to jamming of the paper in the paper guidance channel are perceived in time via a sensing means coupled to the paper levelling gap and an alarm means is activated and/or the paper feed is interrupted.

The disposition of such a paper levelling gap enables the employment of a rigid paper guide pan since irregularities of the paper are evened out before the feed of the paper into the guide pan. A cost-favorable, relatively low-performance stepping motor can be utilized as the drive for the paper feed, the so-called line feed motor.

Multiple folded paper ends are prevented from proceeding into the narrow gap between the platen and a sensitive matrix write head since the sensing means interrupts the paper feed when a paper back-up occurs.

When the present invention is used in teleprinters or other accessible text terminal devices, a malfunctioning paper feed due to paper curvatures is perceived in time so that received information cannot be lost.

The complete imprinting of the paper enables a nearly loss-free processing of the entire paper supply.

BRIEF DESCRIPTION OF THE DRAWINGS

Embodiments of the invention are illustrated in the drawings and are explained in greater detail below by way of example. Shown are.

DESCRIPTION OF THE PREFERRED EMBODIMENTS

Figure 1:
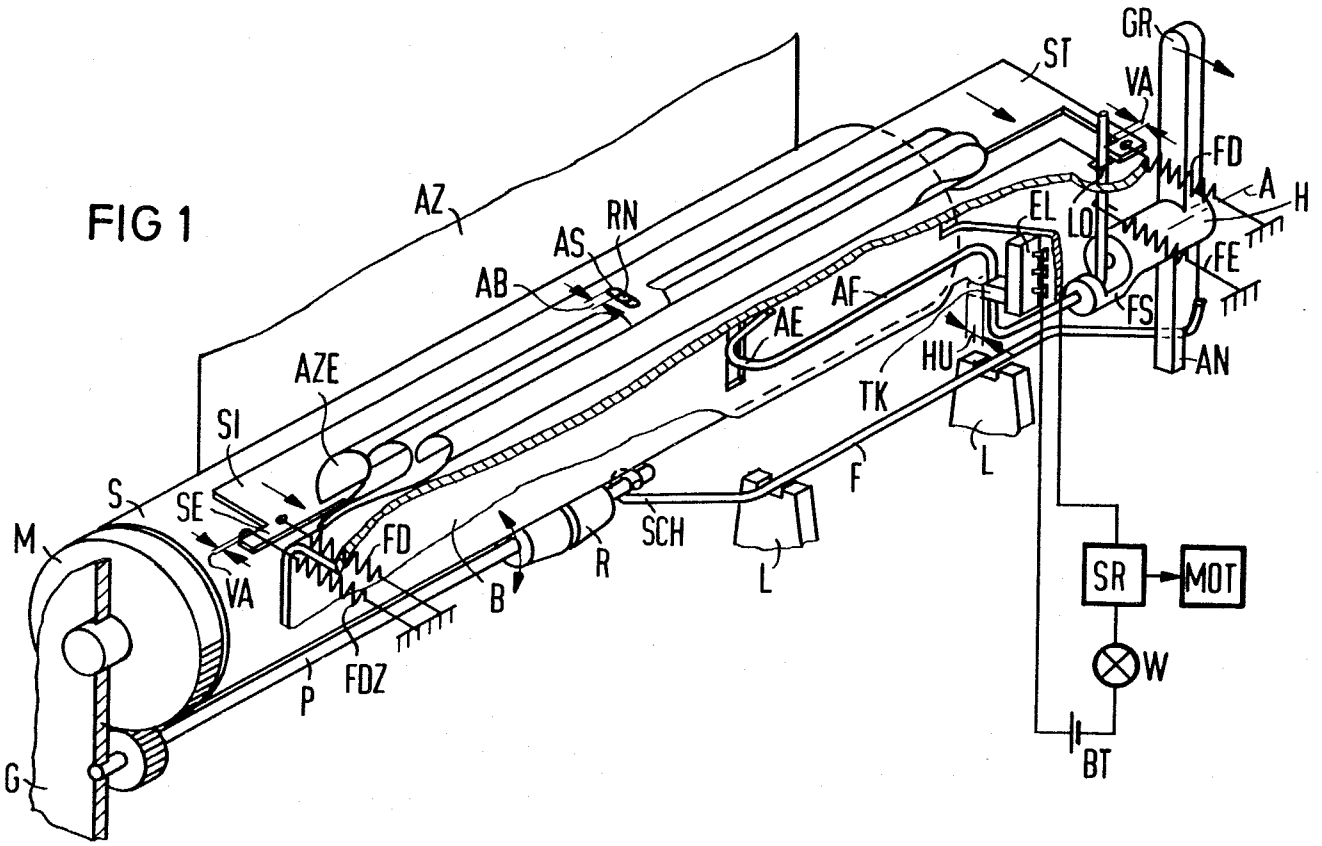
FIG. 1 is a schematic perspective illustration of a paper feed apparatus for interline devices having a levelling gap disposed in the paper guidance channel.

The paper feed apparatus illustrated in the drawings and belonging to a line printer means, in this case a teleprinter, contains a matrix write head (not shown here) that can be moved along a platen. The paper feed apparatus itself consists of a platen S that is seated rotatable and motor-driven in a housing G. A paper transport shaft P having a barrel-shaped pressure roll R seated thereon and rigidly connected to the paper transport shaft P is situated below the platen S and connected to the platen S via a gearing M. The paper transport shaft with the pressure roll R is situated at the end of the paper guidance channel bounded by a paper guidance plate B and is rigidly seated at one side in the housing G and its end is seated in a loop SCH of an arm of a frame-borne spring clip F so as to be pivotable in the arrow direction. Depending upon the type of recording paper employed (continuous stock, single-ply or multi-ply continuous rollpaper, or single-sheets), the pressure roll R can be pressed with greater or lesser pressure against the paper platen or, respectively, against the intervening paper AZ via the spring clip F. The pressure roll R can also be completely pivoted away from insertion or adjustment of the paper. To this end, the spring clip which is seated in guides L has its other arm interacting with a pivoted lever H that is rotatably seated around a shaft A.

The pivoted lever consists of an actual handle piece GR and of a driver piece AN disposed below the handle piece. In the illustrated, engaged condition of the pressure roll R, one end of the spring clip F presses against the driver piece AN under torsional influence. In accord with the arrow direction shown, the pressure roll R can be pivoted away from the platen S via the pivoted lever H.

A sensing spring clip AF is provided in order to perceive the presence of the paper in the paper guidance. The sensing end AE of the sensing spring clip AF, the end AE being bent back loop-like, engages through an opening in the paper guidance plate B and is supported on the platen S. Multiply bent, the sensing spring clip AF itself has its outermost end seated in a clearance LO of the paper guidance plate B, whereby it is pressed against the edge of the clearance LO via a spring FE. The sensing spring clip is thereby guided by a guide segment FS of the pivoted lever H that is disposed opposite the axis of rotation A, whereby that part of the sensing spring clip AF lying between the guide segment FS and the sensing end AE has a U-shaped configuration and presses against an electrical sensing means EL such as a switch.

A paper levelling gap is disposed in the ingress region of the paper guidance channel. This paper levelling gap consists of the stationary paper deflector B and of a slide SI that is displaceable relative to the paper deflector. The slide SI, which may be fabricated of plastic material, has a lateral part ST engaging behind the sensing spring clip AF, namely at a leading interval VA.

A clearance as into which a latch nose RN secured to the housing of the printer engages is disposed in the center of the slide SI. The smallest slot width of the paper levelling gap is thereby defined by the dimension AB. The springs FD attached to the lateral ends ST and SE of the slide hold the slide SI against the detent (latch nose RN). An additional spring FDZ disposed at a clearance of the end SE of the slide is designed such that the stroke or movement of the slide either ensues parallel to the guide pan (not shown) or leads or is amplified on the side ST.

The interaction of the sensing spring clip AF and the electrical switch means EL, the spring clip F and the slide SI is as follows:

When paper is situated in the paper guidance channel, in this case, a multi-ply continuous rollpaper AZ with greatly curved ends AZE, the sensing end AE and, thus, the sensing spring clip AF is lifted off from the platen S. The pivoted lever H is thereby situated in its illustrated, basic position with an engaged pressure roll R. The keytop TK of the electrical sensing means EL rests against the central part of the sensing spring clip. In the illustrated condition, with inserted paper, the electrical sensing means EL is depressed and, thus, a switch contained in the electrical sensing means is open. The open switch interrupts a circuit consisting of a current source BT and of a warning light W with a following switch relay SR so that the warning light is extinguished.

When the highly curved paper end AZE of the multiply paper AZ proceeds into the paper levelling gap, the slide SI is pushed away from the paper deflector B. After an advance of the edge of the lateral part ST of the slide, the sensing lever AF is thereby pulled away from engagement against the paper deflector B and, after compensation of the switching lever HU, the switch in the electrical sensing means EL is closed. The warning light W is thus lit and the switch relay SR is actuated thus deenergizing the motor MOT. The lead of the slide SI via the stroke or gap VA at the end ST ensures that the switching reliability is increased.

If the paper can traverse the paper levelling gap unimpeded with its paper end AZE, then, in accord with its spring behavior, the sensing spring clip AF presses against the platen S in accord with the illustrated arrow direction after the paper AZ has passed. As a result thereof, the keytop TK is likewise moved in the arrow direction and the alarm circuit is closed. The warning light W is also lit then and indicates the end of the paper. In order to completely remove the paper from the paper guidance, the motor MOT can again be briefly engaged via an initiation means (not shown here).

This illumination of the warning light also ensues when the pivoted lever H is moved in the arrow direction for pivoting the paper transport shaft. As a result of the motion, the sensing spring clip AF is pivoted via the eccentric guide segment FS, this agains resulting in a closing of the alarm circuit and an illumination of the warning light W.

Figure 2:
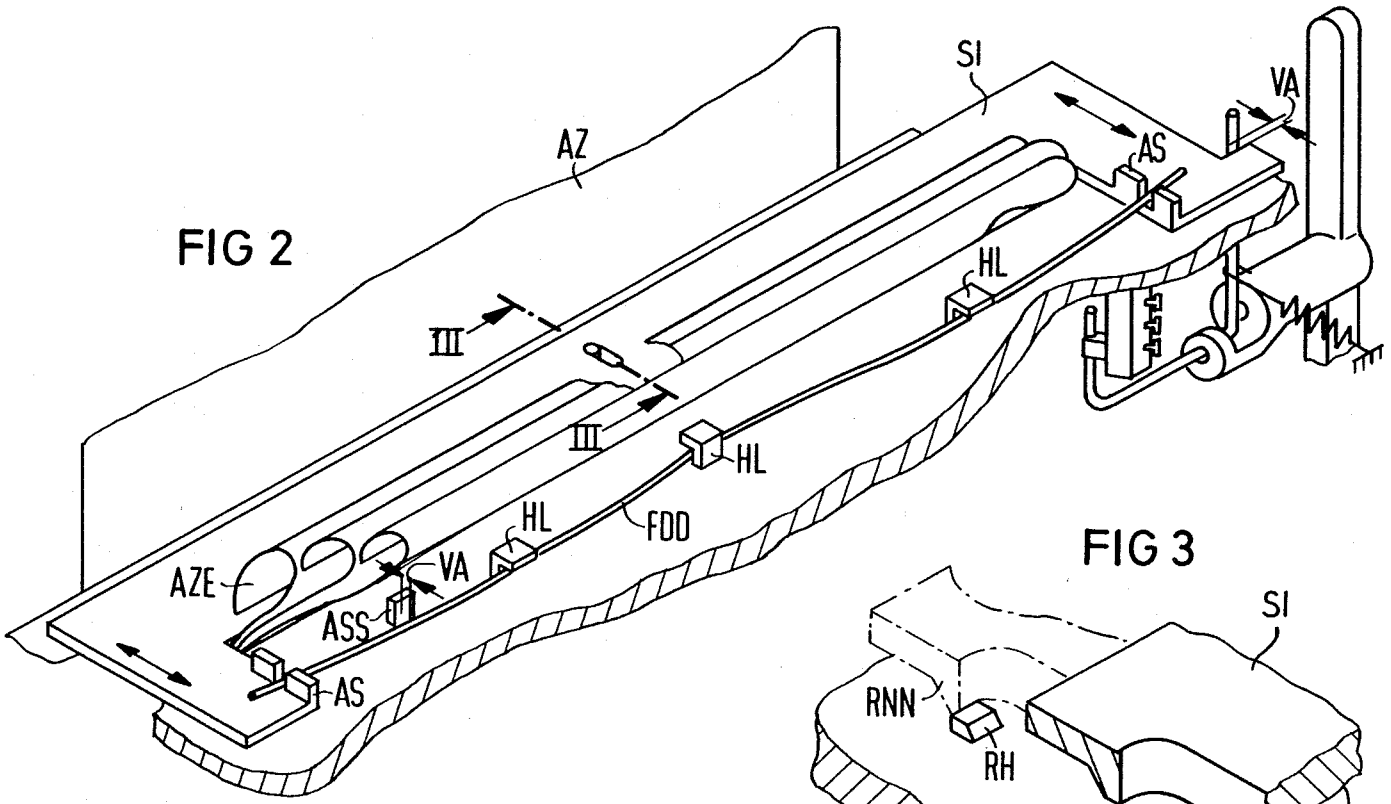
FIG. 2 is a schematic perspective illustration of an embodiment of the paper levelling gap comprising a spring consisting of spring wire and a latch element.

The embodiment according to FIG. 2 differs from that according to FIG. 1 in that the biasing spring means for the slide SI consists of a single spring wire chucked in the support mounts HL of the stationary part of the paper levelling gap. The ends of the spring wire thereby engage in recesses AS of the slide. Corresponding to the embodiment of FIG. 1, a single-sided advance of the slide is produced via a detent ASS disposed at a distance VA in order, as already described, to increase the switching reliability at the switch EL.

Figure 3:
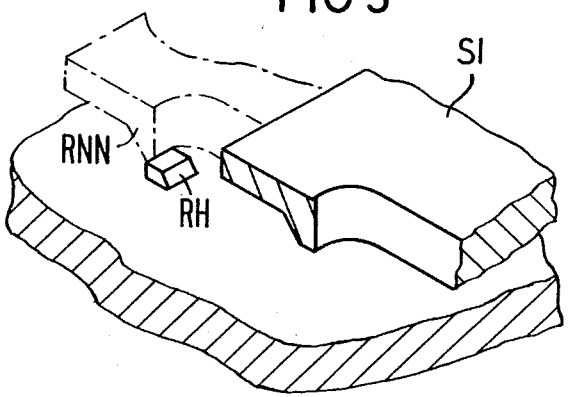
FIG. 3 is an enlarged perspective view of a portion of the device shown in FIG. 2 showing the latch element in detail and taken generally along the lines III—III of FIG. 2.

In accord with the sectional view of FIG. 3, a latch nose RNN is additionally formed on the slide SI, said latch nose RNN interacting with a latch hook RH on the printer housing. The slide SI is held in the open position by the engagement of the latch nose RNN behind the latch hook in order, for example, to facilitate the insertion of the paper.

As is apparent from the foregoing specification, the invention is susceptible of being embodied with various alterations and modifications which may differ particularly from those that have been described in the preceeding specification and description. It should be understood that I wish to embody within the scope of the patent warranted hereon all such modifications as reasonably and properly come within the scope of myr contribution to the art.

I claim as my invention:

1. A paper feed apparatus for the transport of continuous roll paper in a printer having a motor-driven platen and a paper guidance channel partially encircling said platen comprising:

a stationary plate-like member and an opposed movable plate-like member from each other spaced to form a paper leveling gap therebetween, positioned in the ingress region of said paper guidance channel upstream of said platen, at least one of said members contacting said paper along its entire width to smooth out the paper being supplied to the platen through the paper guidance channel, said members extending at least over the width of said paper being transported, said gap having a minimum width present as a function of the thickness of said paper, said movable member being capable of movement away from said stationary member against a spring member to increase the width of said gap in response to deformed paper, a sensing means for detecting movement of said movable member further away from said stationary member than said minimum preset width of said gap, whereby said sensing means interrupts the transport of said paper upon the movement of said movable member beyond a predetermined position.

2. The device of claim 1 wherein said spring member comprises a spring wire chucked along its length to said stationary member and engaged at its end to said movable member.

3. The device of claim 1 wherein said movable member is provided with a latch member to permit the holding of said movable member in an open position with a large gap from said stationary member to allow for insertion of said paper.

4. The device of claim 1 including an alarm means which is activated by said sensing means upon movement of said movable member beyond said predetermined position.

5. The device of claim 1 wherein said spring member comprises a pair of springs, one positioned at each lateral end of said movable member.

6. A paper feed apparatus for the transport of continuous roll paper in a printer having a motor-driven platen and a paper guidance channel partially encircling said platen comprising:

a stationary plate-like member and an opposed movable plate-like member spaced from each other to form a paper leveling gap therebetween, positioned in the ingress region of said paper guidance channel upstream of said platen, at least one of said members contacting said paper along its entire width to smooth out the paper being supplied to the platen through the paper guidance channel, said members extending at least over the width of said paper being transported, said gap having a minimum width preset as a function of the thickness of said paper, said movable member being capable of movement away from said stationary member against a spring member to increase the width of said gap in response to deformed paper, a sensing means for detecting movement of said movable member further away from said stationary member than said preset width of said gap, and an alarm means activatable by said sensing means, whereby said sensing means activates said alarm means upon the movement of said movable member beyond a predetermined position.

7. The device of claim 6 wherein said spring member comprises a spring wire chucked along its length to said stationary member and engaged at its ends to said movable member.

8. The device of claim 16 wherein said movable member is provided with a latch member to permit the holding of said movable member in an open position with a large gap from said stationary member to allow for insertion of said paper.

9. The device of claim 6 wherein said spring member comprises a pair of springs, one positioned at each lateral end of said movable member.

* * * * *